US006162280A

United States Patent [19]

Lehner et al.

[11] Patent Number: 6,162,280

[45] Date of Patent: Dec. 19, 2000

[54] PROCESS FOR HEAT TREATMENT OF ORGANICALLY CONTAMINATED MATERIAL

[75] Inventors: Johann Lehner; Oskar Pammer; Hans Stiasny, all of Linz; Heinz Schöllnhammer; Hubert Zellner, both of Leoben; Wolfgang Trimmel, deceased, late of Linz, all of Austria, by Irene Trimmel, Anna-Maria Trimmel and Stephan Trimmel, heirs

[73] Assignee: Voest-Alpine Indstrienlagenbau GmbH, Australia

[21] Appl. No.: 09/214,781

[22] PCT Filed: Jul. 7, 1997

[86] PCT No.: PCT/AT97/00153

§ 371 Date: Mar. 11, 1999

§ 102(e) Date: Mar. 11, 1999

[87] PCT Pub. No.: WO98/02593

PCT Pub. Date: Jan. 22, 1998

[30] Foreign Application Priority Data

Jul. 11, 1996 [AT] Austria ..... A 1250/96

[51] Int. Cl.[7] ..... C22B 1/20

[52] U.S. Cl. ..... 75/769; 75/962; 75/10.41

[58] Field of Search ..... 75/751, 769, 746, 75/962, 10.41

[56] References Cited

U.S. PATENT DOCUMENTS 5,382,279 1/1995 Anderson, II ..... 75/746

FOREIGN PATENT DOCUMENTS 0437407 7/1991 European Pat. Off. .
4008027 5/1991 Germany .
4414321 10/1995 Germany .
1361191 12/1987 U.S.S.R. .

OTHER PUBLICATIONS

W. Gebert, et al., "PCDD/F Emission Reduction for Sinter Plants", Steel Times, vol. 223, No. 6, Jun. 1995, Surrey, Great Britain, pp. 220–222.

*Primary Examiner*—Melvyn Andrews
*Attorney, Agent, or Firm*—Ostrolenk, Faber, Gerb & Soffen, LLP

[57] ABSTRACT

The technical problem of the invention is to create a process where the second layer is of higher sintering quality and improved waste gas values are achieved. The process according to the invention for the thermal transformation of materials containing organic substances in a two-layer sintering process, charges the second layer (8) containing the organic substances at a maximum layer thickness of 20% of the first layer after ignition of the first layer (1) and thermally treats the second layer when the combustion zone of the first layer ensures the combustion of the organic substances coming from the second layer and entering the combustion zone of the first layer, following the pressure difference, is least 70%. The area above the combustion zone of the first layer still must have a temperature preventing the organic substances coming from the second layer and entering the first layer from condensing.

19 Claims, 1 Drawing Sheet

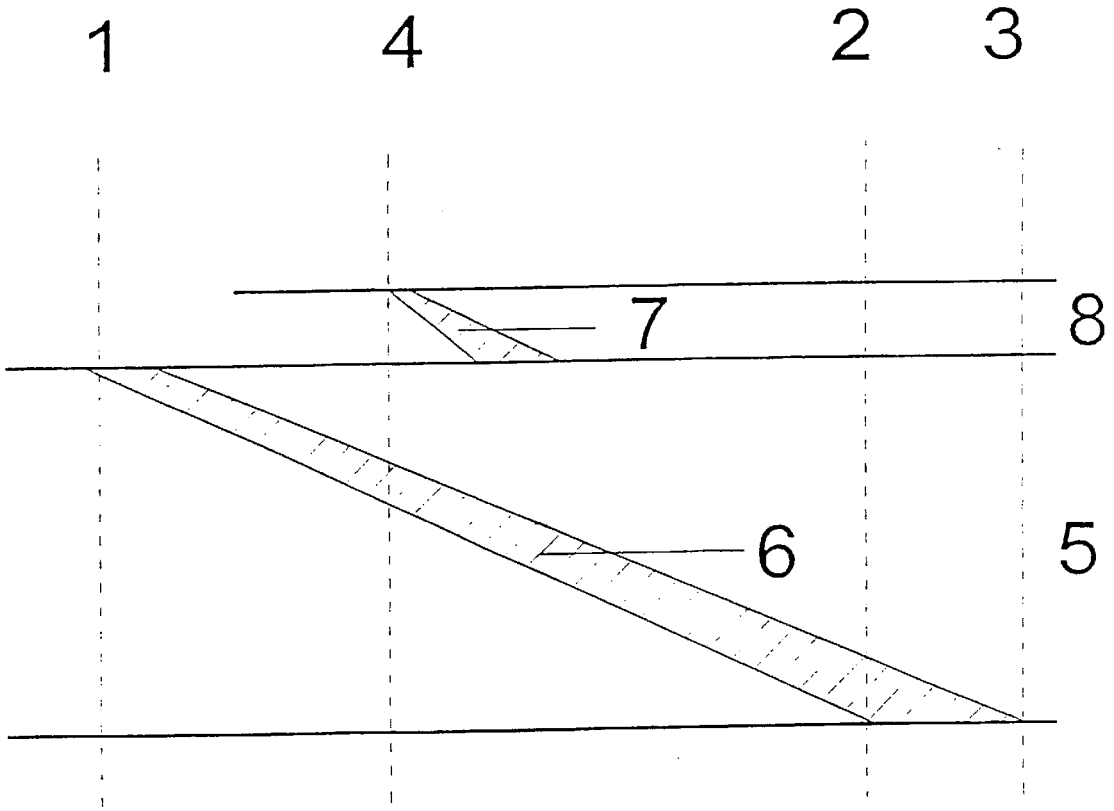
Fig.

PROCESS FOR HEAT TREATMENT OF ORGANICALLY CONTAMINATED MATERIAL

The invention relates to a process for the thermal transformation of organic substances and of materials containing organic substances in a two-layer sintering process, wherein, after ignition of the first layer, a second layer is charged.

During the processing and machining of metallic materials, various fractions of oxidebearing metallic mixes are produced which are contaminated with water as well as with organic separating agents, lubricants or tensides.

In rolling processes, for example, rolling scale is produced as by-product. The rolling scale, which consists of fine particles and accumulated during the rolling process, enters the water circuit and is discharged in the form of rolling scale sludge. Rolling scale always bears organic separating and flotation agents and is thus a product to be disposed of and treated.

Depending on the production process, both the water content and the content of total hydrocarbons amount to 25 weight percent each. Because of this organic contamination, which is not easily degradable, recyclings poses a disposal problem. The thermal destruction of the hydrocarbons in connection with the processing of the partly oxidized metallic mixes, with the residual moisture being vaporized, provides an economical and environmentally compatible process engineering solution. In process control, however, it is to be ensured that no steam distillation of the highly volatile hydrocarbons occurs.

"K. Killmann und L. Schellberg: Mö glichkeiten der Aufarbeitung ö lhaltiger Walzzunder-schlä mme" (possibilities of processing oil-bearing rolling scale sludges), specialized literature: Drifte Duisburger Recycling-Tage, 1988, pp. 177–205, describes possibilities of process control in two-layer sintering processes, wherein, after charging of the first layer onto a sintering belt, this layer is ignited, charged onto the base layer formed in this way and also ignited.

In his doctoral thesis "Development and removal of aerosols in the double sintering process with rolling scale sludge charging", Duisburg Comprehensive University, 1989, pp. 1–3, 108, 109, Eckart Streich describes an improved process control of a sintering process controlled through the times of ignition. The ignition of the upper process is not started until the total waste gas system has reached operating temperature through the bum-off of the lower process, on the one hand, and the upper process should have its bumt-through point one minute before the lower process for safety reasons, on the other hand. This process, however, describes double sintering processes with the thickness of the sinter layers ranging between 200 and 400 mm. These embodiments have the disadvantage that layers formed in this way cause high pressure differences in the air compressor.

A process during which, after charging and ignition of a first sinter base layer, which may also contain solid fuels and volatile organic substances in iron-ore-bearing material, a second layer, which may optionally contain also solid fuels as well as vaporizable organic substances in an ore matrix, is charged and sintered is known from EP 0 437 407 A1. According to an embodiment, this second sinter layer is ignited with a time lag, the ignition time being determined by measuring the waste gas temperature and/or chemical analysis of the waste gases. In this process, sinter layers are formed that feature poor gas permeability owing to their composition and process control.

Accordingly, the technical problem of the invention is to create a process where the second layer is of higher sintering quality and where, moreover, improved waste gas values are achieved.

The technical problem is characterized in that the second layer containing organic substances is charged with a maximum thickness of 20% of the first layer and that thermal treatment of the second layer is started when the combustion zone of the first layer ensures combustion of the organic substances coming from the second layer and entering the combustion zone of the first layer, following the pressure difference, is at least 70% and the area above the combustion zone of the first layer still has a temperature which prevents the organic substances coming from the second layer and entering the first layer from condensing.

This invention for the first time allows ensuring maximum waste gas quality and, thus optimum process conditions through the selection of the thickness of the second sinter layer and through the selection of optimum conditions for thermal treatment.

According to another embodiment of the invention, thermal treatment of the second layer is started at 30–70% of the total sintering time, preferably at 50–60%, from the start of ignition of the first layer until the chemical burnt-through point. In this range, the combustion zone of the sinter base layer has already fully developed and there is still enough burning time left for optimum combustion of the organic substances from the second layer.

According to an embodiment of the invention, thermal treatment of the second layer is carried out at a temperature of the first layer of at least 400° C. Below 400° C., thermal decomposition of organic substances is not guaranteed. Regardless of catalytic effects reducing the activation energy, thermal dissociation of organic substances can be expected from 600° C.

According to another embodiment of the invention, thermal treatment of the second layer is started at a waste gas temperature of at least 50° C. Thus, condensation of higher-volatile substances is suppressed.

Another feature of the invention is that additives, preferably metallothermic substances, are admixed to the organic substances and the materials containing organic substances of the second layer. This has the advantage of allowing the control of the melting behavior of the sinter layer, on the one hand, and of achieving a uniformly sintering layer with a high degree of gas permeability.

According to an embodiment of the invention, the gas mixture required for the thermal treatment and the transport of the organic substances, preferably air, is sucked through the sinter layers. In this way, uniform burn-off of the sinter layers and quantitative burn-off of the organic substances are ensured.

According to another feature of the invention, the thermal treatment of the second layer is carried out under oxidizing conditions. This measure may lead to the destruction of stable organic substances.

According to an embodiment of the invention, the thermal treatment of the second layer is carried out under reducing conditions. In this way, safe reduction is ensured at highly oxidizing sinter mixes.

According to another embodiment of the invention, the thermal treatment of the second layer is carried out by means of external heat supply. This embodiment allows sintering thermally abnormal mixes as well as mixes not fully sintering through the energy content of the sinter mix.

According to another feature of the invention, the external heat supply for the thermal treatment of the second layer is implemented by an electric power supply, preferably by resistance heating. This measure ensures a particularly exact supply of thermal energy at particularly contaminated substance mixes. The fact that the thermal treatment of the second layer takes placed without an open flame provides for another field of application.

According to an embodiment of the invention, the thermal treatment of the second layer is started by ignition. In this way, external heat supply can be dispensed with in the case of exothermally adjusted mixes.

The invention is described in greater detail by means of an embodiment represented in the drawing.

In the figure, bum-off curve 6 of the first layer (5) extends from ignition time 1 to the first comer point of burn-off curve 6, spatial burnt-through point 2, and continues burning up to the second comer point of the burn-off curve, chemical burnt-through point 3. The start of thermal treatment 7 of second sinter layer 8 is preset at time 4 through the characteristics of bum-off curve 6 of sinter base layer 5. In the embodiment, the thickness of sinter base layer 5 is approx. 500 mm and that of the second sinter layer 840 mm. The total sintering time of the first layer is the interval between mark 1 and mark 3.

Sinter base layer 5 is charged and ignited at ignition time 1 in a way that burn-off curve 6 has a thickness of at least 30 mm in the area where its top edge is positioned approx. 150 mm below the top edge of sinter base layer 5 if spatial burnt-through point 2 is located at at least 85% of the length of the suction area of the sintering machine.

The input material for sinter layer 8 is homogenized and preagglomerated with the added metallochemical substances in special intensive mixing and rerolling equipment in order to ensure a layer with a high degree of gas permeability and defined melting behavior after bum-off. Furthermore, it must be ensured that the oxidation potential of the gas sucked through and the oxidation potential of second sinter layer 8 result in a maximum possible quantitative burn-off of the organic substances. Second sinter layer 8 is charged in the area of sinter base layer 5 where the top edge of the combustion zone of sinter base layers is positioned maximally 150 mm below the surface of sinter base layer 5 and bum-off curve 6 has already fully developed, however, has a thickness of at least 30 mm. The thermal treatment of sinter layer 7 is not started before the temperature of the sinter waste gases has ideally exceeded 100° C.

What is claimed is:

1. A two-layer sintering process for the thermal transformation of organic substances and of materials containing organic substances wherein a first layer is ignited in a combustion area and thereafter, a second layer is charged into said area and thermally treated, characterized in that the second layer (8) contains organic substances and is charged at a maximum layer thickness of 20% of the first layer and that the thermal treatment of the second layer (8) is started when the temperature of the combustion zone (6) of the first layer ensures the combustion of at least 70% of the organic substances coming from the second layer and entering the combustion zone (6) of the first layer, following the pressure difference, and the area above the combustion zone (6) of the first layer has a temperature which prevents the organic substances coming from the second layer (8) and entering the first layer from condensing.

2. Process according to claim 1, characterized in that the thermal treatment (7) of the second layer is started at 30–70% of the total sintering time, from the start of ignition of the first layer (1) until the chemical burnt-through point (3).

3. Process according to claim 1, characterized in that the thermal treatment (7) of the second layer is carried out at a temperature of the first layer of at least 400° C.

4. Process as claimed in claim 1, characterized in that the thermal treatment (7) of the second layer is started (4) at a waste gas temperature of at least 50° C.

5. Process according to claim 2, characterized in that the thermal treatment (7) of the second layer is started at 50–60% of the total sintering time from the start of ignition of the first layer (1) until the chemical burnt-through point (3).

6. Process as claimed in claim 1, characterized in that a gas mixture, is provided for the thermal treatment (7) and transport of the organic substances and that this gas mixtures is sucked through the sinter layers.

7. Process as claimed in claim 1, characterized in that the thermal treatment (7) of the second layer is carried out under oxidizing conditions.

8. Process as claimed in at claim 1, characterized in that the thermal treatment (7) of the second layer is carried out under reducing conditions.

9. Process as claimed in at claim 1, characterized in that the thermal treatment (7) of the second layer is carried out through external heat supply.

10. Process as claimed in claim 9, characterized in that the external heat supply for the thermal treatment (7) of the second layer is carried out through the supply of electric power.

11. Process as claimed in claim 1, characterized in that the thermal treatment (7) of the second layer is started (4) by ignition.

12. Process as claimed in claim 1, characterized in that the second layer contains metallothermic substances.

13. Process according to claim 12, characterized in that the thermal treatment (7) of the second layer is started at 30–70% of the total sintering time from the start of ignition of the first layer (1) until the chemical burnt-through point (3).

14. Process according to claim 13, characterized in that the thermal treatment (7) of the second layer is carried out at a temperature of the first layer of at least 400° C.

15. Process as claimed in claim 14, characterized in that the thermal treatment (7) of the second layer is started (4) at a waste gas temperature of at least 50° C.

16. Process as claimed in claim 15, characterized in that a gas mixture is provided for the thermal treatment (7) and transport of the organic substances and that this gas mixture is sucked through the sinter layers.

17. Process according to claim 2, characterized in that the thermal treatment (7) of the second layer is started at 50–60% of the total sintering time from the start of ignition of the first layer (1) until the chemical burnt-through point (3) and wherein the gas mixture is air.

18. Process according to claim 10 in which the supply of electric power is resistance heating.

19. Process as claimed in claim 6 in which the gas mixture is air.

* * * * *

UNITED STATES PATENT AND TRADEMARK OFFICE

CERTIFICATE OF CORRECTION

PATENT NO. : 6,162,280

DATED : December 19, 2000

INVENTOR(S) : Johann Lehner, et al.

It is certified that error appears in the above-identified patent and that said Letters Patent is hereby corrected as shown below:

In the headings under item "[73] Assignee", for "Australia", read --Austria--.

Signed and Sealed this

Eighth Day of May, 2001

*Attest:*

Nicholas P. Godici

NICHOLAS P. GODICI

*Attesting Officer*

*Acting Director of the United States Patent and Trademark Office*